US007249877B2

(12) United States Patent
Johnson et al.

(10) Patent No.: US 7,249,877 B2
(45) Date of Patent: Jul. 31, 2007

(54) LED LAMP BULB ASSEMBLY AND REFLECTOR SYSTEM

(75) Inventors: Ralph J. Johnson, Bedford, NH (US); Paul R. Lyman, Scriba, NY (US)

(73) Assignee: Osram Sylvania Inc., Danvers, MA (US)

( * ) Notice: Subject to any disclaimer, the term of this patent is extended or adjusted under 35 U.S.C. 154(b) by 107 days.

(21) Appl. No.: 10/948,055

(22) Filed: Sep. 23, 2004

(65) Prior Publication Data

US 2006/0061988 A1 Mar. 23, 2006

(51) Int. Cl.
*F21S 8/10* (2006.01)
*F21V 21/00* (2006.01)

(52) U.S. Cl. ..... 362/545; 362/243; 362/247; 362/341; 362/517; 362/518; 362/800

(58) Field of Classification Search ..... 362/227, 362/235, 240–241, 243, 247, 294, 296, 341, 362/345, 507, 509, 516–519, 543–549, 800
See application file for complete search history.

(56) References Cited

U.S. PATENT DOCUMENTS 5,929,788 A * 7/1999 Vukosic ..... 340/908.1
6,682,211 B2 * 1/2004 English et al. ..... 362/545
6,955,451 B2 * 10/2005 Coushaine et al. ..... 362/294
7,008,095 B2 * 3/2006 Coushaine et al. ..... 362/545
2003/0063476 A1 * 4/2003 English et al. ..... 362/545
2005/0068772 A1 * 3/2005 Tessnow ..... 362/247
2006/0072320 A1 * 4/2006 Coushaine et al. ..... 362/249

* cited by examiner

*Primary Examiner*—Sandra O'Shea
*Assistant Examiner*—Jason Moon Han
(74) *Attorney, Agent, or Firm*—William E. Meyer

(57) ABSTRACT

A reflector lamp assembly may be formed with a reflector housing having a reflector with a prescribed reflective surface; the reflector formed with a wall defining a through passage. A lamp bulb assembly having an axially extending stem supports a head extending transverse to the axis, the head having a first generally linearly extending region, a first set of LEDs mounted generally in a row along the region oriented to face in one plane towards a reflector. Electrical connections for the LEDs extend through the head, and stem to the exterior of the assembly for electrical connection. A base extends in the through passage and is mechanically mounted to the optical housing with the LED assembly oriented to face the reflective surface.

14 Claims, 7 Drawing Sheets

LED LAMP BULB ASSEMBLY AND REFLECTOR SYSTEM

BACKGROUND OF THE INVENTION

1. Field of the Invention

The invention relates to electric lamps and particularly to electric lamps with LED light sources. More particularly the invention is concerned with an electric vehicle headlamp with an LED light source.

2. Description of the Related Art Including Information Disclosed Under 37 CFR 1.97 and 1.98

Automobile headlamps are commonly made with incandescent filaments, although some are now being made with arc discharge light sources. Recently LEDs have achieved sufficient light volume and color so as to make an automobile headlamp theoretically possible. Such a headlamp could be both more efficient and longer lived than the rival technologies. There have in fact been a been a number of prototype vehicles shown using LED light sources, but the resulting beam patterns failed to achieve a legal beam pattern. There is then a need for an LED based vehicle headlamp that meets legal beam standards.

BRIEF SUMMARY OF THE INVENTION

A reflector lamp assembly may be formed with a reflector housing having a reflector with a prescribed reflective surface; the reflector formed with a wall defining a through passage. A lamp bulb assembly having an axially extending stem supports a head extending transverse to the axis, the head having a first generally linearly extending region, a first set of LEDs mounted generally in a row along the region oriented to face in one plane towards a reflector. Electrical connections for the LEDs extend through the head, and stem to the exterior of the assembly for electrical connection. A base extends in the through passage and is mechanically mounted to the optical housing with the LED assembly oriented to face the reflective surface.

DETAILED DESCRIPTION OF THE INVENTION

Figure 1:
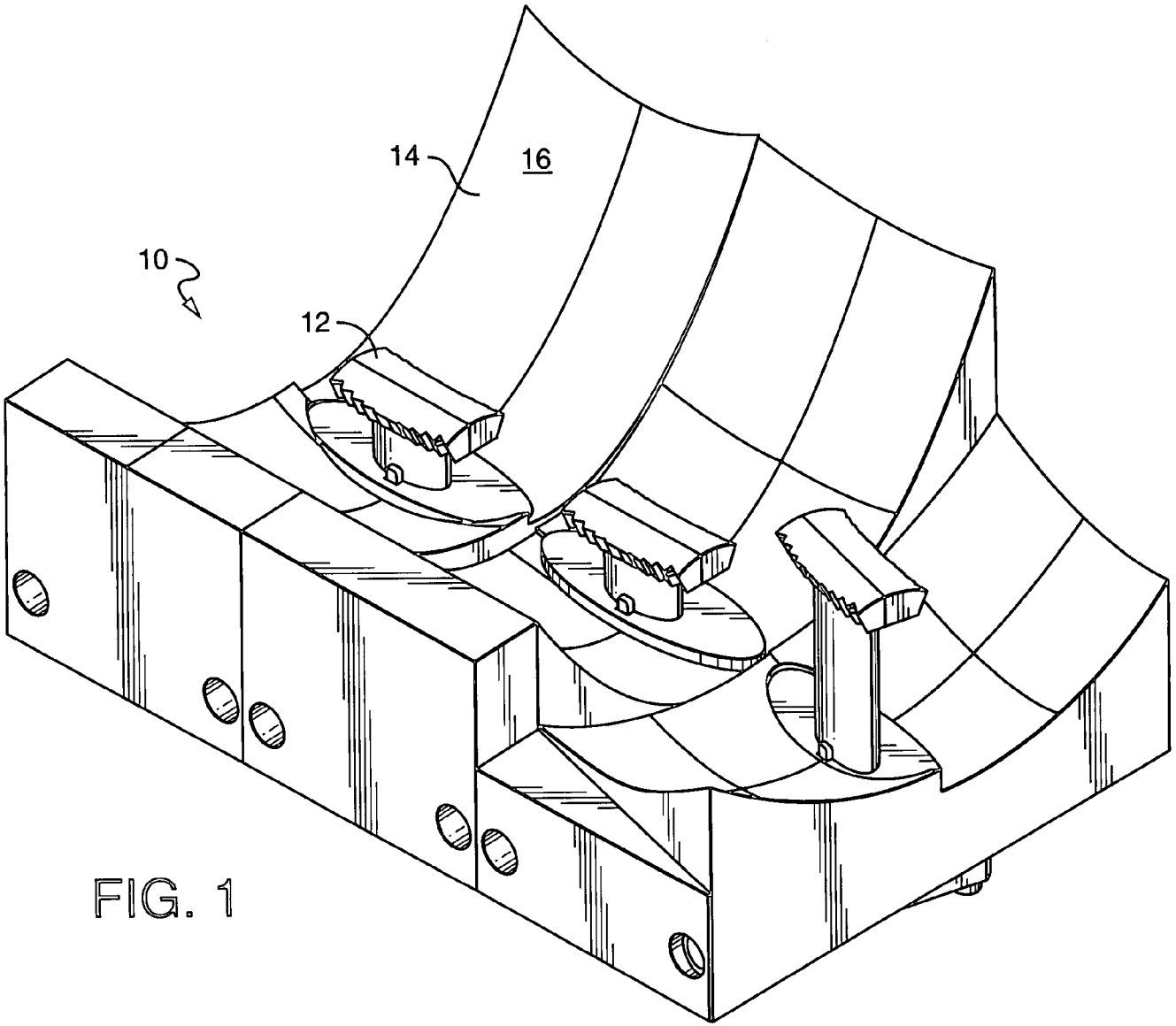
FIG. 1 shows perspective view of a multiple LED lamp and reflector assembly providing an automotive headlamp beam.
Figure 2:
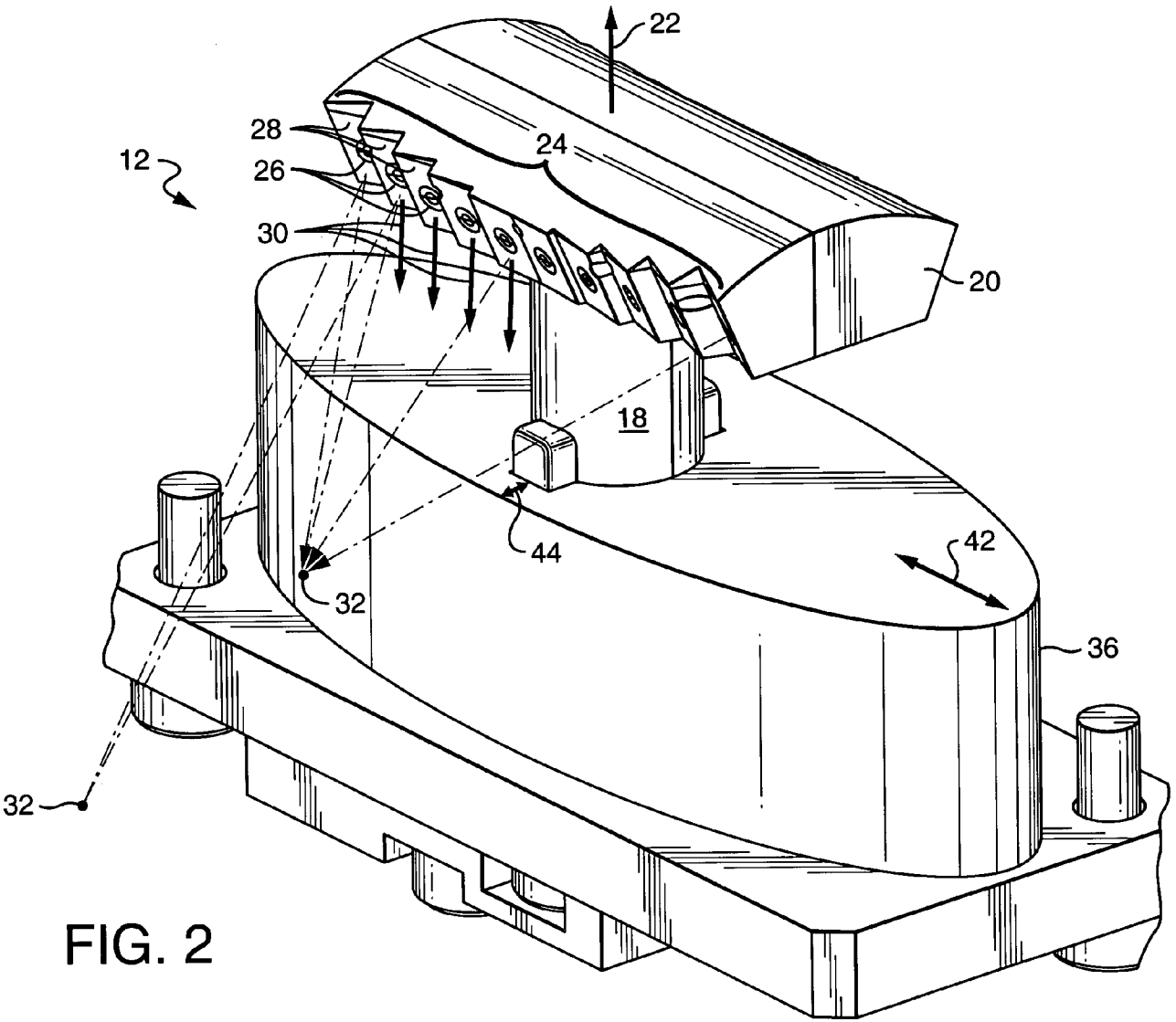
FIG. 2 shows perspective view of an LED lamp assembly.

A vehicle headlamp assembly 10 may be formed with an LED lamp bulb assembly 12 and a reflector 14 with a reflective surface 16. FIG. 1 shows perspective view of a multiple LED lamp and reflector assembly providing an automotive headlamp beam. FIG. 2 shows perspective view of an LED lamp assembly.

The LED lamp bulb assembly 12 is formed from an axially extending stem 18 supporting a head 20 extending transverse to an axis 22. In one embodiment the stem 18 and head 20 had a T shape. The head 20 is formed with a first generally linearly extending region 24. The region 24 may be planar, curved, faceted or staircased, or similarly shaped to have a sequence of areas extended in a line so as to support a row of LED light sources 26. The surface is flat in the sense that a row of planar faces 28 or nearly planar faces have normals 30 that are oriented in a common plane (±5 degrees). It is understood that intermediate such planar faces 28, the connecting surfaces may be oriented in other fashions. In one preferred embodiment, the linear region 24 included a series of staircased planar faces 28, the faces of the staircased sections had normals 30 that were angled generally toward a common intersection point 32, or within a few centimeters of a common intersection point 32. In the preferred embodiment, the stem 18 and head 20 are also formed with portions that are made of high thermal conductivity, and these portions are coupled or commonly formed to effectively conduct heat from one to the other and are further coupled to the base 36 to conduct heat from the head 20 the base 36. In a preferred embodiment, the stem 18 and head 20 are formed from copper or an alloy there of.

Mounted on the first transverse region 24 is a first plural set of LEDs 26 mounted generally in a row along the planar surfaces 28 oriented to face in one plane towards the reflector 14. The LEDs 26 are mounted on the planar faces 28, the nearly planar sections or the staircase faces, as the case may be, so the light emitted from the LEDs 26 is generally centered to parallel the common plane or only a few degrees there from (±5 degrees). Orienting the LEDs 26 to generally point in a common plane simplifies optical design processing and enables the LEDs 26 to simulate a linear source such as a typical incandescent filament. In a more preferred embodiment, the LEDs 26 are further pointed to have a common intersection point 32, (or within a few centimeters of a common point). It is understood that the common intersection point 32 may be in front of or behind the LEDs 26, so that the light emitted by LEDs 26 optically appears to be from the common intersection point 32, or appears to pass through the common intersection point 32. The LEDs 26 then simulate a common source point. In the preferred embodiment, the LEDs 26 are mounted closely in pairs, two each to a common planar face 28. The pairs of LEDs 26 effectively then operate as single large LEDs. With a sufficient number of LEDs 26 mounted along the row, the same or a similar amount of light (lumens) may be projected in the common plane, as would be emitted by a filament or point source. In this way the row of LEDs 26 can simulate a filament or a point source in an optical design.

Figure 3:
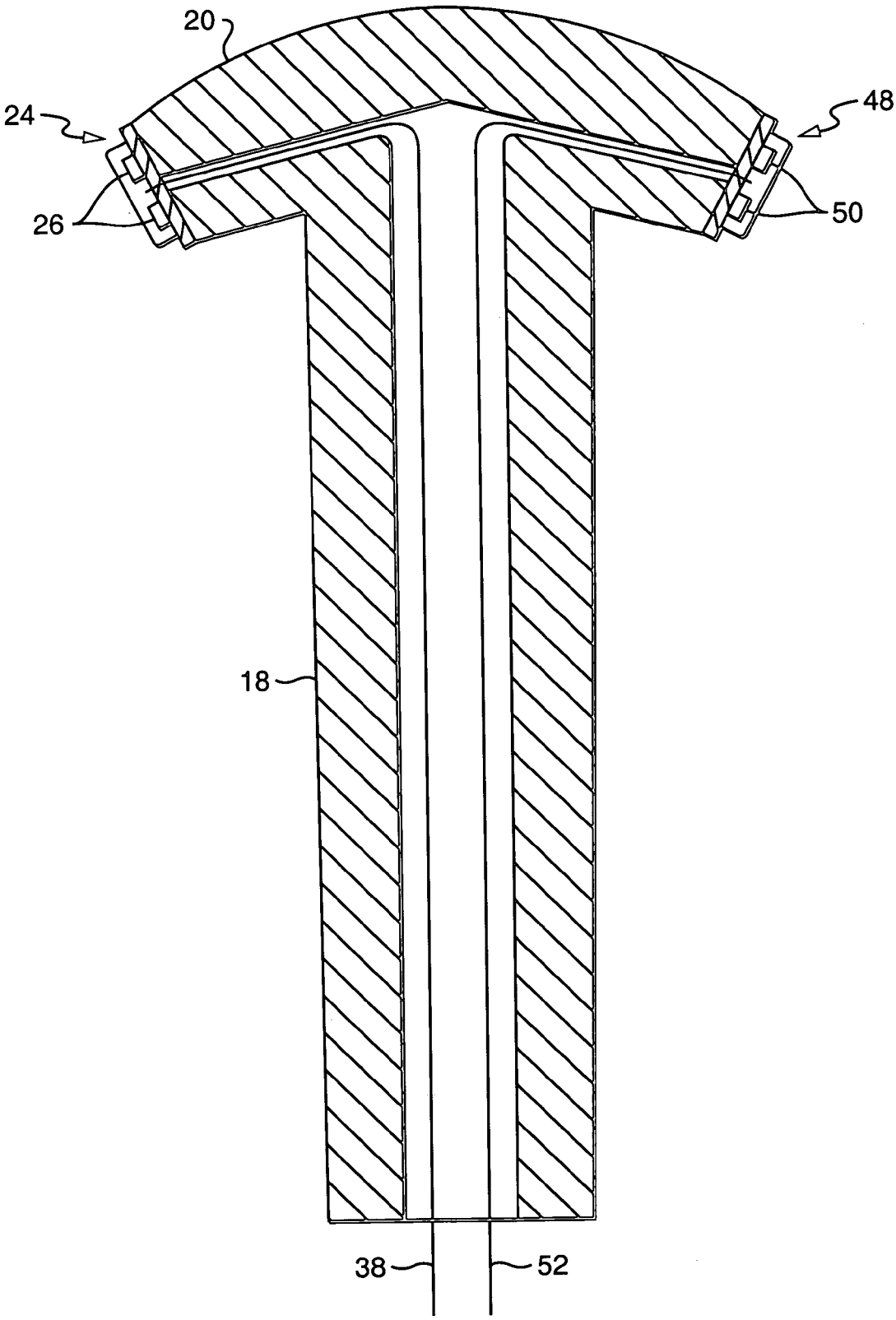
FIG. 3 shows a cross sectional view of an LED lamp head and stem assembly.

FIG. 3 shows a cross sectional view of an LED lamp stem 18 and head 20 assembly. Electrical connections 38 for the LEDs 26 extend through the stem 18, and head 20, to the exterior of the assembly for electrical connection. In the preferred embodiment, the electrical connections 38 pass through core passages or channels formed in the stem 18 and the head 20 emerging on the head 20 at or near the points where the LEDs 26 are mounted on the surfaces 28. At the second end, the electrical connections 38 emerge from the stem 18 near the base 36, where the electrical connections 38 may be extended or coupled to other electrical connectors for electrical connection with an outside electric power source.

The stem 18 and head 20 are supported by a base 36. The base 36 has an axial cross sectional configuration sized and shaped to cover the corresponding cross sectional size and shapes of the axial projection of the stem 18 and head 20. With the T shaped stem 18 and head 20 structure, one preferred base 36 had an oval shape whose major axis 42 was greater than the width of the head 20, and whose minor axis 44 was greater than the depth of the head 20 and stem 18. The base 36 is otherwise formed to mate with a receiving passageway formed in the reflector 14 housing. In this way the stem 18 and head 20 may pass through the optical housing passage, and the optical housing or reflector 14 may be sealingly mated with the base 36.

In a further preferred embodiment, the head 20 is formed with a similar second transverse surface 48 generally oriented to point normally in a common plane different from the first common plane. Similarly, mounted on the second surface 48 is a second set of LEDs 50 mounted generally in a similar row along the second surface 48 oriented to face in a second plane towards a reflective surface. A second set of electrical connections 52 are similarly formed, although the common core of the stem 18 may be used for commonly wiring all the LEDs mounted on the head 20 surfaces 24, 48.

Figure 4:
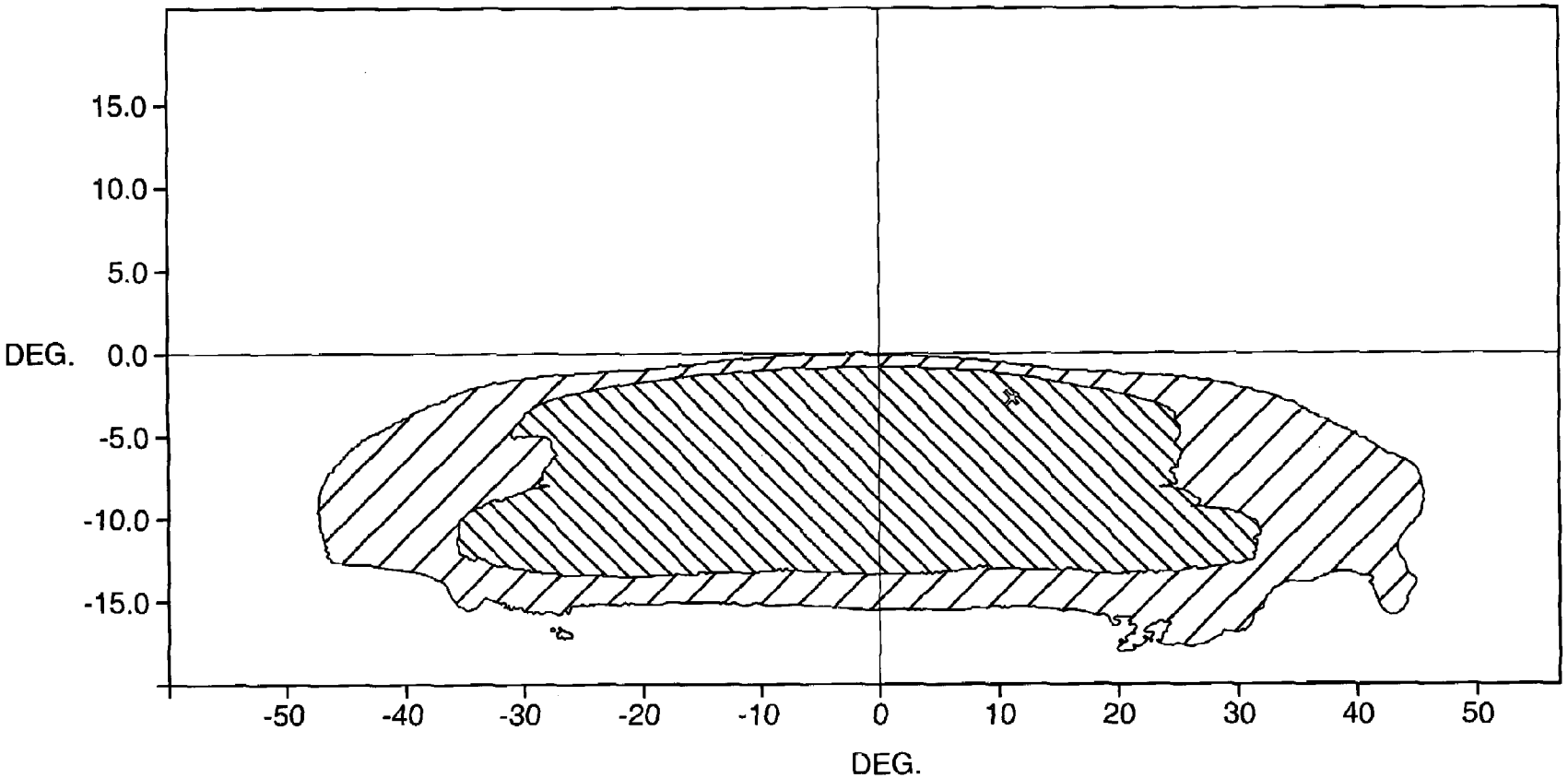
FIG. 4 shows an isocandella chart of a projected spread beam.
Figure 5:
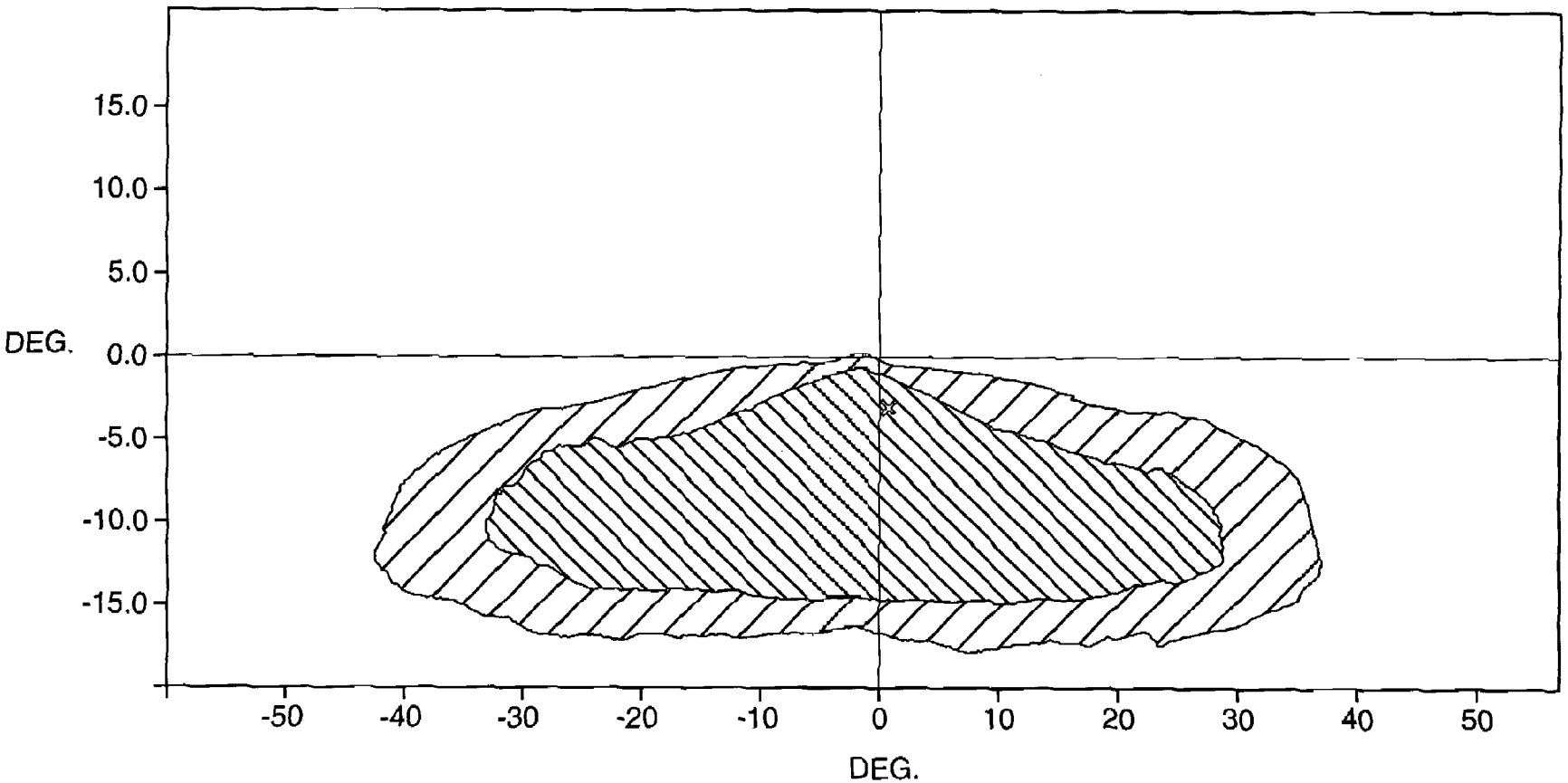
FIG. 5 shows an isocandella chart of a projected hot spot beam.
Figure 6:
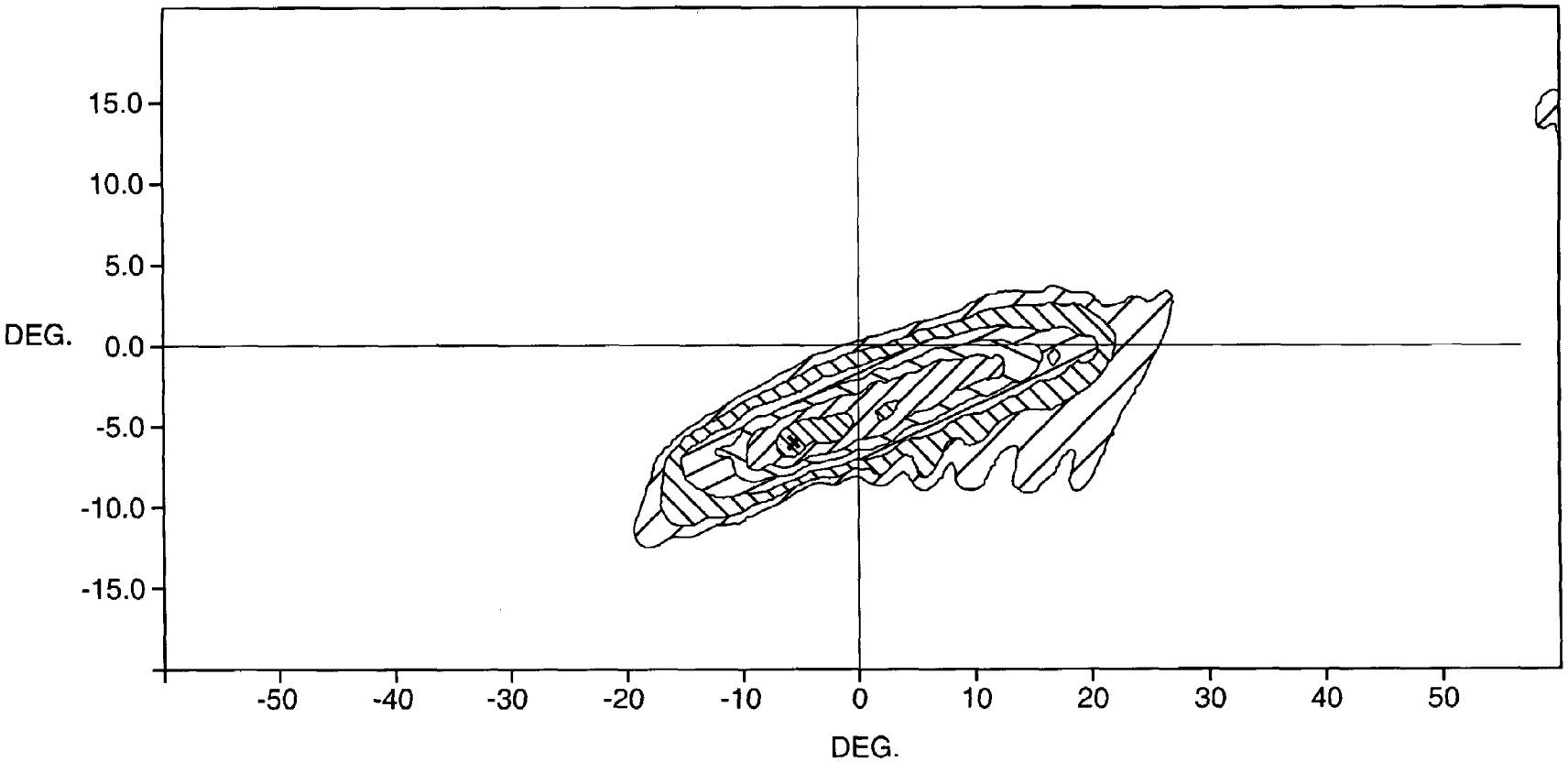
FIG. 6 shows an isocandella chart of a projected side beam.
Figure 7:
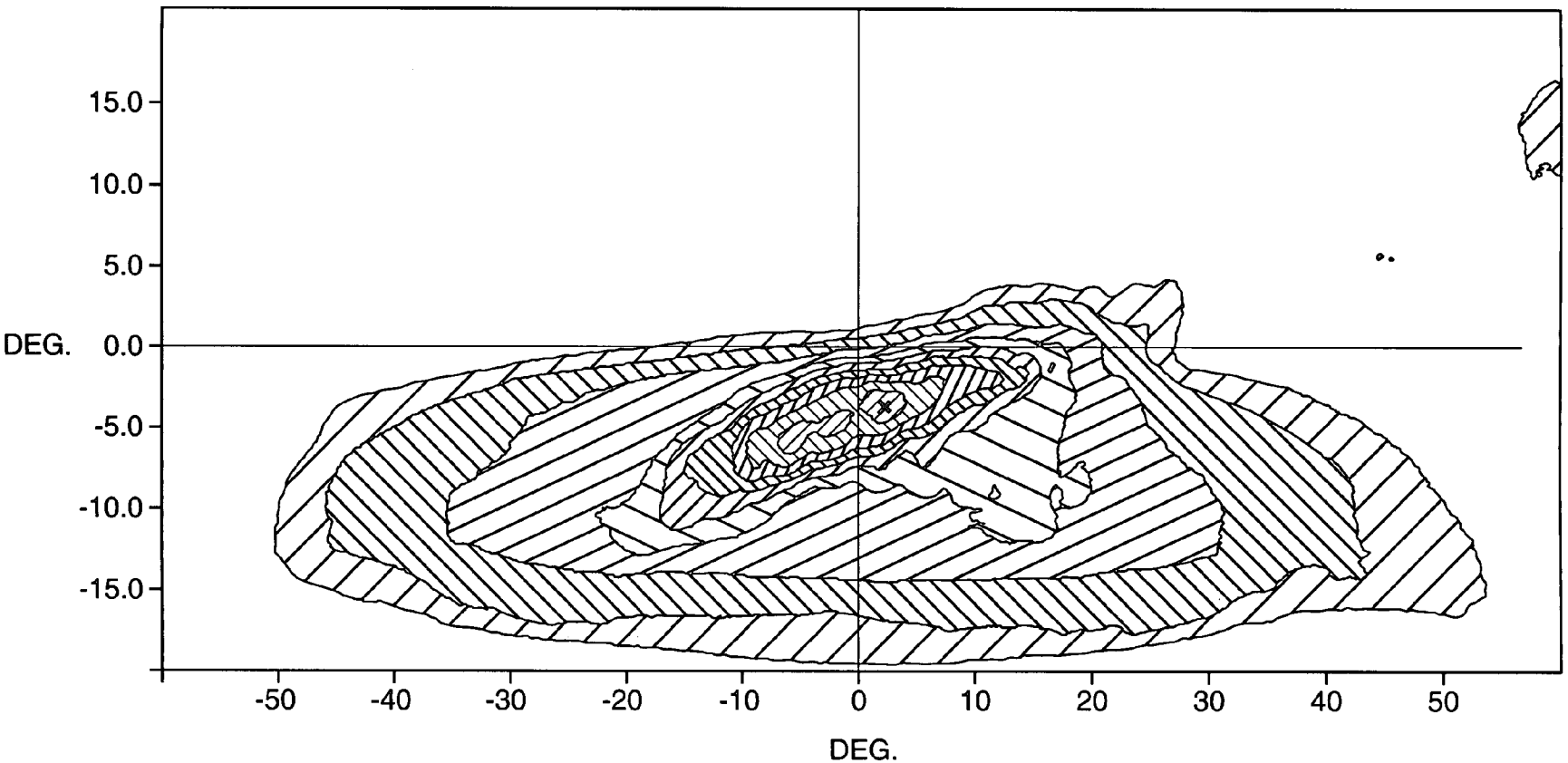
FIG. 7 shows an isocandella chart of a combined projected beam.

The LED lamp assembly 12 is then coupled to a reflector 14 with a reflective surface 16. The LEDs 26 mounted in a row, and oriented by the common intersection point 32 can then shine light to the reflective surface 16 as if they were a common light source, either a simulated linear filament or a simulated single point source. The reflector 14 is designed to project the received LED light to a field to be illuminated according to a desired beam pattern. Such reflector design is considered to be a matter of design choice. Further the final beam pattern for the field illumination may be built from one or more such LED lamp bulb assemblies 12. In one embodiment, an automotive beam pattern was built from three LED lamp bulb assemblies 12. A first LED lamp assembly formed a spread beam pattern, extending approximately at or below the horizontal and spread approximately equally to each side. FIG. 4 shows an isocandella chart of the projected spread beam features. A second LED lamp assembly formed a hot spot beam pattern, extending approximately at or slightly above the horizontal center point. FIG. 5 shows an isocandella chart of the projected hot spot beam features. A third LED lamp assembly formed a roadside illumination beam pattern, extending approximately above the horizontal and spread only to one side. FIG. 6 shows an isocandella chart of the projected side beam features. In combination, the three beam patterns formed a legal European headlamp beam pattern. FIG. 7 shows an isocandella chart of the combined projected beams. One can then increase the number of LEDs in a row, or increase the number of rows, or increase the number of LED lamp assemblies and associated reflectors sufficient to build up a beam pattern with the desired number of lumens and the desired beam pattern. It is understood that individual regulation of each LED or sets of LEDs is possible with circuitry thereby providing active beam sculpting for condition specific lighting. Included functions can be high and low beam, fog and daylight running, turn and other warning signaling, turning beams, and so on.

In one embodiment, three LED lamp assemblies were constructed and mated with a single reflector body having three respective portions of the reflective surface. Each LED lamp assembly had a T shaped stem and head, with two transverse rows of LEDs. The stems and heads were made of copper and had core passages for the LED source power connections. The heads each included two transverse rows of ten planar sections. Each planar section had a normal that pointed generally in a plane common for that respective row of LEDs. Moreover, the normals generally pointed to a respective common point on the reflector for that set of LEDs. Mounted on each planar face were two LED light sources generally oriented by the face of the corresponding planar face to shine generally parallel with the common plane and more particularly towards the common intersection point. There were ten such steps, two of such linear rows, and two LEDs for each step. There were then 20 LEDs per row and 40 LEDs per LED lamp bulb assembly. The reflector portions were biconic, asperical surfaces. The vertical curvatures were basically parabolic to direct light generally parallel to the horizontal. The horizontal curvatures provided axial spread to the right and left as appropriate. The first LED lamp and reflector portion assembly provided a beam spread pattern as shown in FIG. 4. The second LED lamp and reflector portion assembly provided a hot spot beam pattern as shown in FIG. 5. The third LED lamp and reflector portion provided an asymmetric finger of illumination at 15 degrees to form a roadside illumination pattern as shown in FIG. 6. In combination the LED lamps and reflector portions assembly provided a vehicle headlamp beam pattern, FIG. 7. When all three patterns were combined the result was a legal European low beam headlamp pattern.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A lamp bulb assembly comprising:

an axially extending stem supporting a head extending transverse to the stem axis, the head having a first generally linearly extending region, a first set of LEDs mounted generally in a row alone the linearly extending region oriented to face towards a reflector, electrical connections for the LEDs extending through the head and stem to the exterior of the assembly for electrical connection, and a base with a coupling to mechanically mount the assembly with respect to an optical housing wherein the normals from the LEDs are oriented in a common plane, and wherein the normals generally have a common intersection point.

2. The lamp bulb assembly in claim 1, having a second transverse linearly extending region, a second set of LEDs mounted generally in a row along the second transverse linearly extending region oriented to face in a second plane towards the reflector, and electrical connections for the second set of LEDs extending through the head, and stem to the exterior of the assembly for electrical connection.

3. The assembly in claim 1, wherein the LEDs are oriented to the reflector and face away from an optical focal point of the reflector.

4. A lamp bulb assembly comprising:

an axially extending stem supporting a head extending transverse to the stem axis, the head having a first generally linearly extending region, a first set of LEDs mounted generally in a row along the linearly extending region oriented to face towards a reflector, electrical connections for the LEDs extending through the head and stem to the exterior of the assembly for electrical connection, and a base with a coupling to mechanically mount the assembly with respect to an optical housing;

wherein the normals from the LEDs are oriented in a common plane, and wherein the linearly extending region includes a plurality of planar faces having normals oriented in a common plane, and generally having a common intersection point, and respective LEDs are mounted on respective planar faces.

5. A lamp bulb assembly comprising:

an axially extending stem supporting a head extending transverse to the stem axis, the head having a first generally linearly extending region, a first set of LEDs mounted generally in a row along the linearly extending region oriented to face towards a reflector, electrical connections for the LEDs extending through the head and stem to the exterior of the assembly for electrical connection, and a base with a coupling to mechanically mount the assembly with respect to an optical housing;

wherein the normals from the LEDs are oriented in a common plane, and wherein the linearly extending region is staircased with the normals of the step faces angled generally toward a common intersection point in front of the linearly extending region.

6. A lamp bulb assembly comprising:

an axially extending stem supporting a head extending transverse to the stem axis, the head having a first generally linearly extending region, a first set of LEDs mounted generally in a row along the linearly extending region oriented to face towards a reflector, electrical connections for the LEDs extending through the head and stem to the exterior of the assembly for electrical connection, and a base with a coupling to mechanically mount the assembly with respect to an optical housing;

wherein the normals from the LEDs are oriented in a common plane, and wherein the linearly extending region is staircased with the normals of the step faces angled generally from a common intersection point behind the linearly extending region.

7. A lame bulb assembly comprising:

an axially extending stem supporting a head extending transverse to the stem axis, the head having a first generally linearly extending region, a first set of LEDs mounted generally in a row along the linearly extending region oriented to face towards a reflector, electrical connections for the LEDs extending through the head and stem to the exterior of the assembly for electrical connection, and a base with a coupling to mechanically mount the assembly with respect to an optical housing wherein the normals from the LEDs are oriented in a common plane, and having a second generally horizontally transverse extending region similarly supporting a second plural set of LEDs oriented to generally face the reflector, wherein the first set of LEDs faces an upper half of the reflector and the second set of LEDs faces a lower half of the reflector.

8. A lamp bulb assembly comprising:

an axially extending stem supporting a head extending transverse to the stem axis, the head having a first generally linearly extending region, the linear region including a plurality of planar faces having normals oriented to pass near a common plane, and pass near a common point, the head and the stem are formed from copper or an alloy thereof; a first set of LEDs mounted generally in a row along the first linearly extending region oriented to face in one plane towards a reflector, the LEDs are mounted on the planar faces, the normals from the LEDs are oriented to pass near a common plane, and near a common point, electrical connections for the LEDs extending through the head and stem to the exterior of the assembly for electrical connection, a base with a coupling to mechanically mount the assembly with respect to an optical housing; and having a second transverse linearly extending region;

a second set of LEDs mounted generally in a row along the second linearly extending region oriented to pass near a second plane towards a reflector, and electrical connections for the second set of LEDs extending through the head and stem to the exterior of the assembly for electrical connection.

9. A reflector lamp assembly comprising:

A reflector housing having a plurality of reflector regions each with a respective prescribed reflective surface; each reflector region formed with a respective wall defining a respective through passage, a plurality of lamp bulb assemblies each having:

an axially extending stem supporting a head extending transverse to the stem axis, the head having a first generally linearly extending region, a first set of LEDs mounted generally in a row along the region oriented to face in one plane towards a respective reflector, electrical connections for the LEDs extending through the head and stem to the exterior of the assembly for electrical connection, and a base extending in the respective through passage and mechanically mounted in the respective one of the defined through passages, with the respective LED assembly oriented to face the respective reflective surface.

10. A reflector lamp assembly in claim 9, wherein at least one reflector region provides a spread beam pattern.

11. A reflector lamp assembly in claim 9, wherein at least one reflector region provides a hot spot pattern.

12. A reflector lamp assembly in claim 9, wherein at least a first reflector region provides a spread beam pattern, wherein at least a second reflector region provides a hot spot pattern; and wherein at least a third reflector region provides a third beam pattern.

13. The assembly in claim 9, wherein the transverse region is formed as a series of adjacent faces, each LED mounted on a respective region face, and each LED turned to face particular region of the reflector.

14. A reflector lamp assembly comprising:

A reflector housing having a reflector with a prescribed reflective surface; the reflector formed with a wall defining a through passage, a lamp bulb assembly having:

an axially extending stem supporting a head extending transverse to the stem axis, the head having a first generally linearly extending region, a first set of LEDs mounted generally in a row along the linearly extending region oriented to face in one plane towards the reflector, electrical connections for the LEDs extending through the head and stem to the exterior of the assembly for electrical connection, and a base extending in the through passage and mechanically mounted to the housing with the LED assembly oriented to face the reflective surface.

* * * * *